US006523277B1

(12) United States Patent
Claggett

(10) Patent No.: US 6,523,277 B1
(45) Date of Patent: Feb. 25, 2003

(54) APPARATUS FOR DRYING AND STACKING TREATED WORKPIECES

(76) Inventor: Jimmie D. Claggett, 388 Enterprise Dr., Nicholasville, KY (US) 40356

( * ) Notice: Subject to any disclaimer, the term of this patent is extended or adjusted under 35 U.S.C. 154(b) by 0 days.

(21) Appl. No.: 10/024,097

(22) Filed: Dec. 18, 2001

(51) Int. Cl.[7] ..... F26B 19/00

(52) U.S. Cl. ..... 34/218; 34/207; 34/105; 34/203; 34/437; 34/590; 34/104

(58) Field of Search ..... 34/272, 437, 438, 34/440, 580, 581, 590, 104, 105, 106, 201, 203, 207, 218, 164; 101/40; 118/230

(56) References Cited

U.S. PATENT DOCUMENTS

| | | | | |
|---|---|---|---|---|
| 913,285 A | | 2/1909 | Harbeck | |
| 2,950,805 A | | 8/1960 | Heimlicher et al. | |
| 3,231,061 A | | 1/1966 | Borkmann | |
| 3,469,670 A | | 9/1969 | Cartwright | |
| 3,563,170 A | | 2/1971 | Cvacho et al. | |
| 3,608,699 A | | 9/1971 | Voris, Jr. | |
| 3,766,851 A | | 10/1973 | Sirvet et al. | |
| 3,960,073 A | * | 6/1976 | Rush | 101/40 |
| 4,085,517 A | | 4/1978 | Thiel et al. | |
| 4,614,064 A | * | 9/1986 | Bailey et al. | 51/420 |
| 5,272,970 A | | 12/1993 | Burke | |
| 5,564,334 A | | 10/1996 | Burke | |
| 5,579,791 A | * | 12/1996 | Beswick et al. | 134/129 |
| 6,186,931 B1 | * | 2/2001 | Calvert et al. | 493/8 |
| 6,288,377 B1 | * | 9/2001 | Wu et al. | 219/656 |
| 6,238,557 B1 | * | 12/2001 | Grishchenko et al. | 432/122 |

* cited by examiner

*Primary Examiner*—Ira S. Lazarus
*Assistant Examiner*—K. B. Rinehart
(74) *Attorney, Agent, or Firm*—Stoll, Keenon & Park, LLP

(57) ABSTRACT

Apparatus for drying and stacking treated workpieces includes a housing defining a drying chamber; a workpiece carrying assembly mounted to the housing for moving the workpieces along a travel path through the drying chamber, including an endless strand trained around a plurality of wheels, and a plurality of pins spaced along and projecting outwardly from the strand for supporting and carrying workpieces; a workpiece removal assembly for removing workpieces from the pins including a ramp formed with an abutment surface and a slot formed therein through which the pins can pass to engage workpieces being carried on the pins wherein each workpiece is forced off its respective pin as the respective pin advances through the slot; a workpiece collection arrangement for receiving workpieces removed from the pins, with the travel path being generally vertically oriented and the pins being generally horizontally oriented wherein workpieces fall into the workpiece collection arrangement; and a workpiece ejector assembly in mechanical communication with the workpiece collection arrangement including a movable ram to selectively eject workpieces from the workpiece collection arrangement.

70 Claims, 6 Drawing Sheets

APPARATUS FOR DRYING AND STACKING TREATED WORKPIECES

BACKGROUND OF THE INVENTION

The present invention relates broadly to apparatus including heated ovens for drying treated material and, more particularly, to an apparatus for drying and stacking printed beverage ware such as thin-walled plastic cups.

Often beverage containers or other liquid holding vessels are treated in some form with liquid materials that require a drying or curing process. Often thin-walled plastic drinking cups are printed with corporate logos or other indicia. One current process involves screen-printing on individual cups using a liquid ink that must be dried prior to stacking and further distribution of the beverage ware or cups.

One apparatus used for drying is a peg oven which is essentially a box containing a plurality of traveling pegs on which cups ride individually, one cup per peg. The box forms a drying chamber wherein continuing treatment such as heating or exposure to UV lamps occurs. Once the cups are dry they must be removed from the machine in order to package and ship the cups to the end users.

Removal of the cups from the traveling pegs typically involves some form of grasping apparatus that engages the cups or other vessels and places them in a stack or in some other machine for further treatment. These additional mechanisms can add complexity and expense to the peg oven. Further, such mechanisms add size and bulk to the drying apparatus, occupying often-expensive floor space.

Accordingly, there exists a need for a simple device for extracting cups from traveling pegs in a peg oven and stacking those cups for further processing which may include shipment.

SUMMARY OF THE INVENTION

It is accordingly an object of the present invention to provide an apparatus for drying and stacking treated workpieces that provides enhanced workpiece removal and stacking capabilities.

It is another object of the present invention to provide such an apparatus that will selectively eject a predetermined number of workpieces from the apparatus.

To those ends, and according to one preferred embodiment of the present invention, an apparatus for drying and stacking treated workpieces including a housing defining a drying chamber; a workpiece carrying assembly mounted to the housing for moving the workpieces through a predetermined travel path through the drying chamber, the workpiece carrying assembly including an endless strand trained around a plurality of wheels, and a plurality of pins spaced along and projecting outwardly from the strand for supporting and carrying workpieces along the predetermined travel path; a workpiece removal assembly for removing workpieces from the pins including a ramp disposed in the travel path and formed with an abutment surface and a slot formed therein through which the pins can pass, the ramp presenting the abutment surface to engage workpieces being carried on the pins wherein each workpiece is forced off its respective pin as the respective pin advances through the slot; and a workpiece collection arrangement mounted to the housing for receiving workpieces removed from the pins.

Preferably, the travel path is generally vertically oriented and the pins are generally horizontally oriented wherein workpieces removed from the pins fall into the workpiece collection arrangement. It is further preferred that the workpiece collection arrangement includes a generally horizontally oriented platform for receiving workpieces from the workpiece removal assembly and a pair of generally vertically oriented walls disposed adjacent the travel path to reduce non-vertical movement of the workpieces as the workpieces fall to the platform. Further, the walls may be laterally movably adjustable and the apparatus may further comprise an assembly for selectively holding and releasing the walls to facilitate adjustment thereof.

It is preferred that the workpieces are nestable and the apparatus further comprises a vibration inducing assembly in mechanical communication with the workpiece collection arrangement to induce workpieces in the workpiece collection arrangement to nest and form a stack. Further, the workpiece collection arrangement includes a pair of generally vertically oriented walls disposed adjacent the travel path to reduce non-vertical movement of the workpieces as the workpieces form the stack. It is further preferred that the walls are laterally movably adjustable and the apparatus further comprises an assembly for selectively holding and releasing the walls to facilitate adjustment thereof to facilitate adjustment thereof.

Preferably, the apparatus further comprises a workpiece ejector assembly in mechanical communication with the workpiece collection arrangement to eject workpieces from the workpiece collection arrangement. Further, the workpieces may form a stack when nested and workpiece ejector assembly may include a movable ram to selectively eject a workpiece stack from the workpiece collection arrangement.

It is preferable that the apparatus further comprise a counter assembly for counting workpieces carried on the pins. Further, the workpieces may form a stack when nested and the workpiece ejector assembly may include a movable ram to selectively eject a workpiece stack from the workpiece collection arrangement responsive to a signal from the counter assembly when a predetermined number of workpieces has been carried on the pins. Preferably, the workpiece collection arrangement includes a generally vertically oriented pivotable support arm to support workpieces in the workpiece collection assembly. It is further preferred that the apparatus may include a motor-driven air circulation assembly to circulate air within the drying chamber to assist in drying treated workpieces.

According to another preferred embodiment, the present invention is particularly suited for drying and stacking treated drinkware, including printed plastic beverage cups. To that end, another preferred embodiment of the present invention is directed to an apparatus for drying and stacking printed drinkware including a housing defining a drying chamber; a drinkware carrying assembly mounted to the housing for moving the drinkware through a predetermined travel path through the drying chamber, the drinkware carrying assembly including an endless chain trained around a plurality of sprockets, and a plurality of pins spaced along and projecting outwardly from the chain for supporting and carrying drinkware along the predetermined travel path; a drinkware removal assembly for removing drinkware from the pins including a ramp disposed in the travel path and formed with an abutment surface and a slot formed therein through which the pins can pass, the ramp presenting the abutment surface to engage drinkware being carried on the pins wherein a respective drinkware unit is forced off its respective pin as the respective pin advances through the slot; and a drinkware collection arrangement mounted to the housing for receiving drinkware removed from the pins.

It is preferable that the travel path is generally vertically oriented and the pins are generally horizontally oriented wherein drinkware removed from the pins falls into the drinkware collection arrangement. It is further preferred that the drinkware collection arrangement includes a generally horizontally oriented platform for receiving drinkware from the drinkware removal assembly and a pair of generally vertically oriented walls disposed adjacent the travel path to reduce non-vertical movement of the drinkware as the drinkware removed from the pins falls to the platform. Further, the walls may be laterally movably adjustable and the apparatus further comprises an assembly for selectively holding and releasing the walls to facilitate adjustment thereof.

Preferably, the drinkware is nestable and the apparatus further comprises a vibration inducing assembly in mechanical communication with the drinkware collection arrangement to induce drinkware in the drinkware collection arrangement to nest and form a stack. It is further preferred that the drinkware collection arrangement includes a pair of generally vertically oriented walls disposed adjacent the travel path to reduce non-vertical movement of the drinkware as the drinkware forms the stack. The walls may be laterally movably adjustable and the apparatus further may further comprise an assembly for selectively holding and releasing the walls to facilitate adjustment thereof.

It is further preferable that the drinkware is nestable and the apparatus further comprises a drinkware ejector assembly in mechanical communication with the drinkware collection arrangement to eject drinkware from the drinkware collection arrangement. It is preferred that the drinkware forms a stack when nested and drinkware ejector assembly includes a movable ram to selectively eject a drinkware stack from the drinkware collection arrangement.

Preferentially, the apparatus further comprises a counter assembly for counting workpieces carried on the pins. Further, the workpieces may form a stack when nested and the workpiece ejector assembly may include a movable ram to selectively eject a workpiece stack from the workpiece collection arrangement responsive to a signal from the counter assembly when a predetermined number of workpieces has been carried on the pins. In addition, the drinkware collection arrangement may include a generally vertically oriented pivotable support arm to support drinkware in the drinkware collection assembly.

It is preferred that the apparatus further include a motor-driven air circulation assembly to circulate air within the drying chamber to assist in drying treated drinkware.

According to another preferred embodiment of the present invention, an apparatus for drying and stacking treated workpieces includes a housing defining a drying chamber; a workpiece carrying assembly mounted to the housing for moving the workpieces through a predetermined travel path through the drying chamber, the workpiece carrying assembly including an endless strand trained around a plurality of wheels, and a plurality of pins spaced along and projecting outwardly from the strand for supporting and carrying workpieces along the predetermined travel path; a workpiece removal assembly for removing workpieces from the pins; a workpiece collection arrangement mounted to the housing for receiving workpieces removed from the pins, with the travel path being generally vertically oriented and the pins being generally horizontally oriented wherein workpieces fall into the workpiece collection arrangement; and a workpiece ejector assembly in mechanical communication with the workpiece collection arrangement including a movable ram to selectively eject workpieces from the workpiece collection arrangement.

It is preferred that the apparatus further includes the apparatus further comprises a counter assembly for counting workpieces carried on the pins. Preferably, the workpieces form a stack when nested and the workpiece ejector assembly includes a movable ram to selectively eject a workpiece stack from the workpiece collection arrangement responsive to a signal from the counter assembly when a predetermined number of workpieces has been carried on the pins. Preferentially, the workpiece collection arrangement includes a generally horizontally oriented platform for receiving workpieces from the workpiece removal assembly and a pair of generally vertically oriented walls disposed adjacent the travel path to reduce non-vertical movement of the workpieces as the workpieces fall to the platform. It is further preferred that the walls are laterally movably adjustable and the apparatus further comprises an assembly for selectively holding and releasing the walls to facilitate adjustment thereof Preferably, the workpieces are nestable and the present invention further includes a vibration inducing assembly in mechanical communication with the workpiece collection arrangement to induce workpieces in the workpiece collection arrangement to nest and form a stack. It is further preferred that the workpiece collection arrangement include a pair of generally vertically oriented walls disposed adjacent the travel path to reduce non-vertical movement of the workpieces as the workpieces form the stack. Preferentially, the walls are laterally movably adjustable and the apparatus further comprises an assembly for selectively holding and releasing the walls to facilitate adjustment thereof. Further, the workpiece collection arrangement may include a generally vertically oriented pivotable support arm to support workpieces in the workpiece collection assembly.

It is preferred that the apparatus further include a motor-driven air circulation assembly to circulate air within the drying chamber to assist in drying treated workpieces.

According to another preferred embodiment of the present invention, the present invention is particularly suited for drying and stacking treated drinkware, including printed plastic beverage cups. To that end, an apparatus for drying and stacking treated drinkware includes a housing defining a drying chamber; a drinkware carrying assembly mounted to the housing for moving the drinkware through a predetermined travel path through the drying chamber, the drinkware carrying assembly including an endless strand trained around a plurality of wheels, and a plurality of pins spaced along and projecting outwardly from the strand for supporting and carrying drinkware along the predetermined travel path; a drinkware removal assembly for removing drinkware from the pins; a drinkware collection arrangement mounted to the housing for receiving drinkware removed from the pins, with the travel path being generally vertically oriented and the pins being generally horizontally oriented wherein drinkware removed from the pins falls into the drinkware collection arrangement; and a drinkware ejector assembly in mechanical communication with the drinkware collection arrangement including a movable ram to selectively eject drinkware from the drinkware collection arrangement.

Preferably, the apparatus firer comprises a counter assembly for counting workpieces carried on the pins. It is further preferred that the workpieces form a stack when nested and the workpiece ejector assembly includes a movable ram to selectively eject a workpiece stack from the workpiece collection arrangement responsive to a signal from the counter assembly when a predetermined number of workpieces has been carried on the pins.

Preferentially, the drinkware collection arrangement includes a generally horizontally oriented platform for receiving drinkware from the drinkware removal assembly and a pair of generally vertically oriented walls disposed adjacent the travel path to reduce non-vertical movement of the drinkware as the drinkware removed from the pins falls to the platform. Preferably, the walls are laterally movably adjustable and the apparatus further comprises an assembly for selectively holding and releasing the walls to facilitate adjustment thereof.

It is further preferred that the drinkware is nestable and the apparatus further comprises a vibration inducing assembly in mechanical communication with the drinkware collection arrangement to induce drinkware in the drinkware collection arrangement to nest and form a stack. It is also preferred that the drinkware collection arrangement includes a pair of generally vertically oriented walls disposed adjacent the travel path to reduce non-vertical movement of the drinkware as the drinkware form the stack. Preferentially, the walls are laterally movably adjustable and the apparatus further comprises an assembly for selectively holding and releasing the walls to facilitate adjustment thereof.

It is further preferred that the drinkware removal assembly includes a ramp disposed in the travel path and formed with an abutment surface and a slot formed therein through which the pins can pass, the ramp presenting the abutment surface to engage drinkware being carried on the pins wherein a respective drinkware unit is forced off its respective pin as the respective pin advances through the slot. Preferably, the workpiece collection arrangement includes a generally vertically oriented pivotable support arm to support workpieces in the workpiece collection assembly. It is further preferred that the apparatus include a motor-driven air circulation assembly to circulate air within the drying chamber to assist in drying treated workpieces.

According to another preferred embodiment of the present invention, an apparatus for drying and stacking treated workpieces includes a housing defining a drying chamber; a workpiece carrying assembly mounted to the housing for moving the workpieces through a predetermined travel path through the drying chamber, the workpiece carrying assembly including an endless strand trained around a plurality of wheels, and a plurality of pins spaced along and projecting outwardly from the strand for supporting and carrying workpieces along the predetermined travel path; a workpiece removal assembly for removing workpieces from the pins including a ramp disposed in the travel path and formed with an abutment surface and a slot formed therein through which the pins can pass, the ramp presenting the abutment surface to engage workpieces being carried on the pins wherein each workpiece is forced off its respective pin as the respective pin advances through the slot; a workpiece collection arrangement mounted to the housing for receiving workpieces removed from the pins, with the travel path being generally vertically oriented and the pins being generally horizontally oriented wherein workpieces fall into the workpiece collection arrangement; and a workpiece ejector assembly in mechanical communication with the workpiece collection arrangement including a movable ram to selectively eject workpieces from the workpiece collection arrangement.

It is preferential that the apparatus further comprise a counter assembly for counting workpieces carried on the pins. Preferably, the workpieces form a stack when nested and the workpiece ejector assembly includes a movable ram to selectively eject a workpiece stack from the workpiece collection arrangement responsive to a signal from the counter assembly when a predetermined number of workpieces has been carried on the pins.

Preferably, the workpiece collection arrangement includes a generally horizontally oriented platform for receiving workpieces from the workpiece removal assembly and a pair of generally vertically oriented walls disposed adjacent the travel path to reduce non-vertical movement of the workpieces as the workpieces fall to the platform. It is further preferred that the walls are laterally movably adjustable and the apparatus further comprises an assembly for selectively holding and releasing the walls to facilitate adjustment thereof.

Preferably, the workpieces are nestable and the apparatus further comprises a vibration inducing assembly in mechanical communication with the workpiece collection arrangement to induce workpieces in the workpiece collection arrangement to nest and form a stack. It is preferred that the workpiece collection arrangement includes a pair of generally vertically oriented walls disposed adjacent the travel path to reduce non-vertical movement of the workpieces as the workpieces form the stack. Further, the walls may be laterally movably adjustable and the apparatus further comprises an assembly for selectively holding and releasing the walls to facilitate adjustment thereof. It is additionally preferred that the workpiece collection arrangement includes a generally vertically oriented pivotable support arm to support workpieces in the workpiece collection assembly.

It is preferred that the apparatus further includes a motor-driven air circulation assembly to circulate air within the drying chamber to assist in drying treated workpieces.

According to another preferred embodiment of the present invention, the present invention is particularly suited for drying and stacking treated drinkware, including printed plastic beverage cups. To that end, an apparatus for drying and stacking treated drinkware includes a housing defining a drying chamber; a drinkware carrying assembly mounted to the housing for moving the drinkware through a predetermined travel path through the drying chamber, the drinkware carrying assembly including an endless strand trained around a plurality of wheels, and a plurality of pins spaced along and projecting outwardly from the strand for supporting and carrying drinkware along the predetermined travel path; a drinkware removal assembly for removing drinkware from the pins including a ramp disposed in the travel path and formed with an abutment surface and a slot formed therein through which the pins can pass, the ramp presenting the abutment surface to engage drinkware being carried on the pins wherein a respective drinkware unit is forced off its respective pin as the respective pin advances through the slot; a drinkware collection arrangement mounted to the housing for receiving drinkware removed from the pins, with the travel path being generally vertically oriented and the pins being generally horizontally oriented wherein drinkware removed from the pins falls into the drinkware collection arrangement; and a drinkware ejector assembly in mechanical communication with the drinkware collection arrangement including a movable ram to selectively eject drinkware from the drinkware collection arrangement.

Preferably, the apparatus further comprises a counter assembly for counting workpieces carried on the pins. It is preferential that the workpieces form a stack when nested and the workpiece ejector assembly includes a movable ram to selectively eject a workpiece stack from the workpiece collection arrangement responsive to a signal from the counter assembly when a predetermined number of workpieces has been carried on the pins.

It is further preferred that the drinkware collection arrangement includes a generally horizontally oriented platform for receiving drinkware from the drinkware removal assembly and a pair of generally vertically oriented walls disposed adjacent the travel path to reduce non-vertical movement of the drinkware as the drinkware removed from the pins falls to the platform. Preferably, the walls are laterally movably adjustable and the apparatus further comprises an assembly for selectively holding and releasing the walls to facilitate adjustment thereof. It is preferred that the drinkware is nestable and the apparatus further comprises a vibration inducing assembly in mechanical communication with the drinkware collection arrangement to induce drinkware in the drinkware collection arrangement to nest and form a stack. Preferably, the drinkware collection arrangement includes a pair of generally vertically oriented walls disposed adjacent the travel path to reduce non-vertical movement of the drinkware as the drinkware form the stack.

It is further preferred that the walls are laterally movably adjustable and the apparatus further comprises an assembly for selectively holding and releasing the walls to facilitate adjustment thereof. Further, the workpiece collection arrangement includes a generally vertically oriented pivotable support arm to support workpieces in the workpiece collection assembly.

Preferably, the apparatus further includes a motor-driven air circulation assembly to circulate air within the drying chamber to assist in drying treated workpieces.

By the above the present invention provides an apparatus for drying and stacking treated workpieces, such as printed beverage cups, that will efficiently dry the cups, stack the cups and eject the cups from the apparatus.

DESCRIPTION OF THE PREFERRED EMBODIMENT

Figure 1:
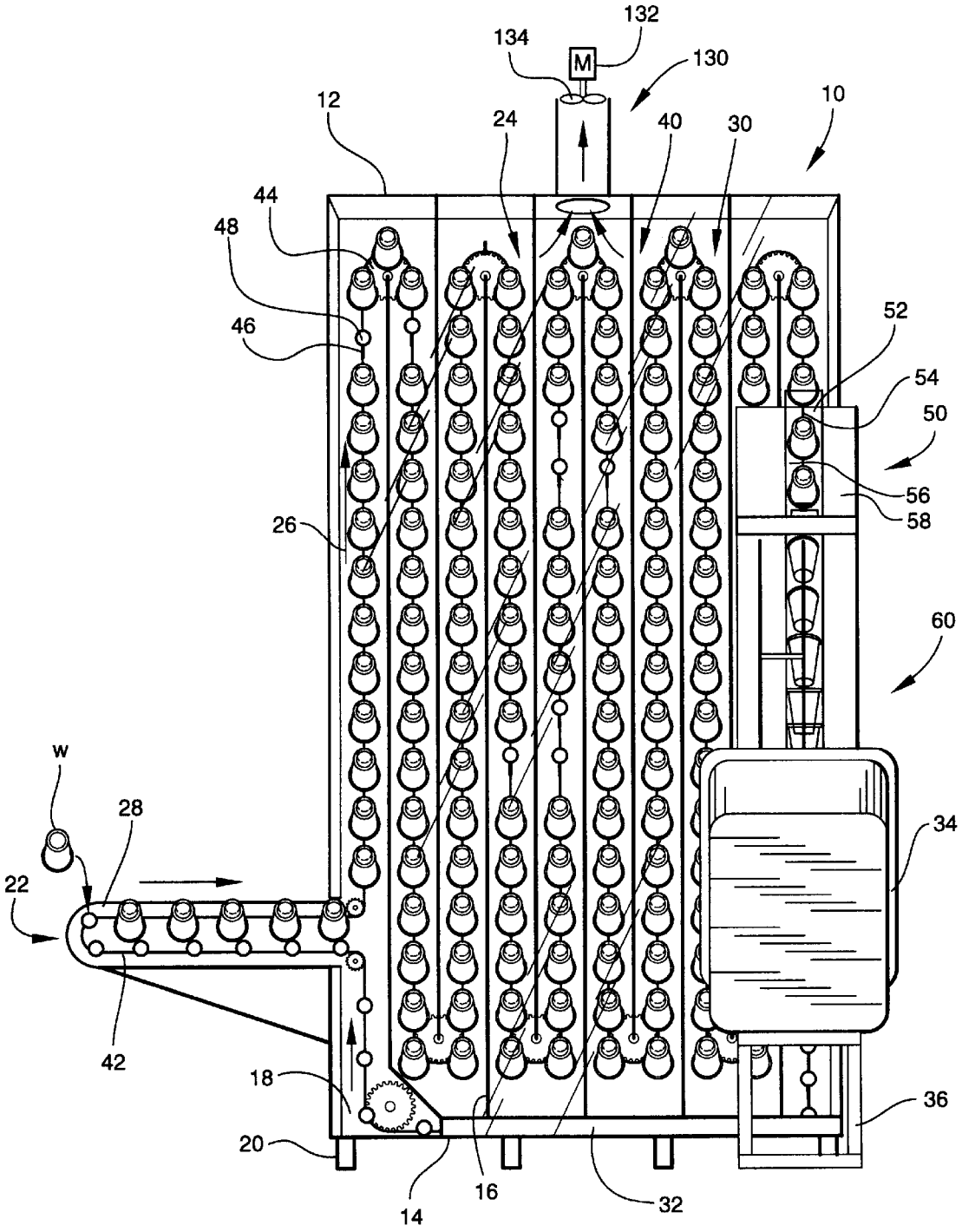
FIG. 1 is a perspective view of an apparatus for drying and stacking treated workpieces according to the preferred embodiment of the present invention.

Turning now to the drawings, and, more particularly to FIG. 1, an apparatus for drying and stacking treated workpieces, particularly beverage cups or drinkware, is illustrated generally at 10 and includes a generally rectangular, upstanding housing 12 supported in a floor standing manner by several legs 20. The housing 12 is defined by external walls 14 that serve as an encasement for the operational features of the apparatus which will be explained in greater detail hereinafter.

The apparatus 10 is configured for transporting a plurality of beverage ware, hereinafter referred to generally as "cups" along a serpentine path through the housing 12 for drying purposes. The cups W have been treated in some manner that requires individual drying. Typically, the cups W will have been imprinted using a dye or ink which must dry on the individual cups W prior to stacking the cups W for shipment and delivery.

The housing 12 includes a plurality of internal walls 16 that act to define a travel path 26 and a drying chamber 24 along the travel path 26. Along one side of the apparatus 10 an input channel 28 exists in order to move cups from a worker (not shown) to the drying chamber 24. The internal walls 16 within the drying chamber 24 define a series of vertical channels 30 and a horizontal return channel 32 below the vertical channel 30 which will be explained in greater detail hereinafter. A transparent front panel 18 covers the drying chamber 24 and the horizontal return channel 32. A receiving bin 34 is provided on a floor standing frame 36 to receive cups W that have been processed and placed in a stack S as will be seen in greater detail hereinafter.

It should also be noted that while the present invention is discussed in terms of cups and beverage ware, the present invention is capable of being used with workpieces of other types and hence, the common term workpiece is often used in place of the term "cup" or "beverage ware" within the application. It should therefore be understood that the present invention is capable of broader uses than merely drying and stacking beverage ware.

Figure 2:
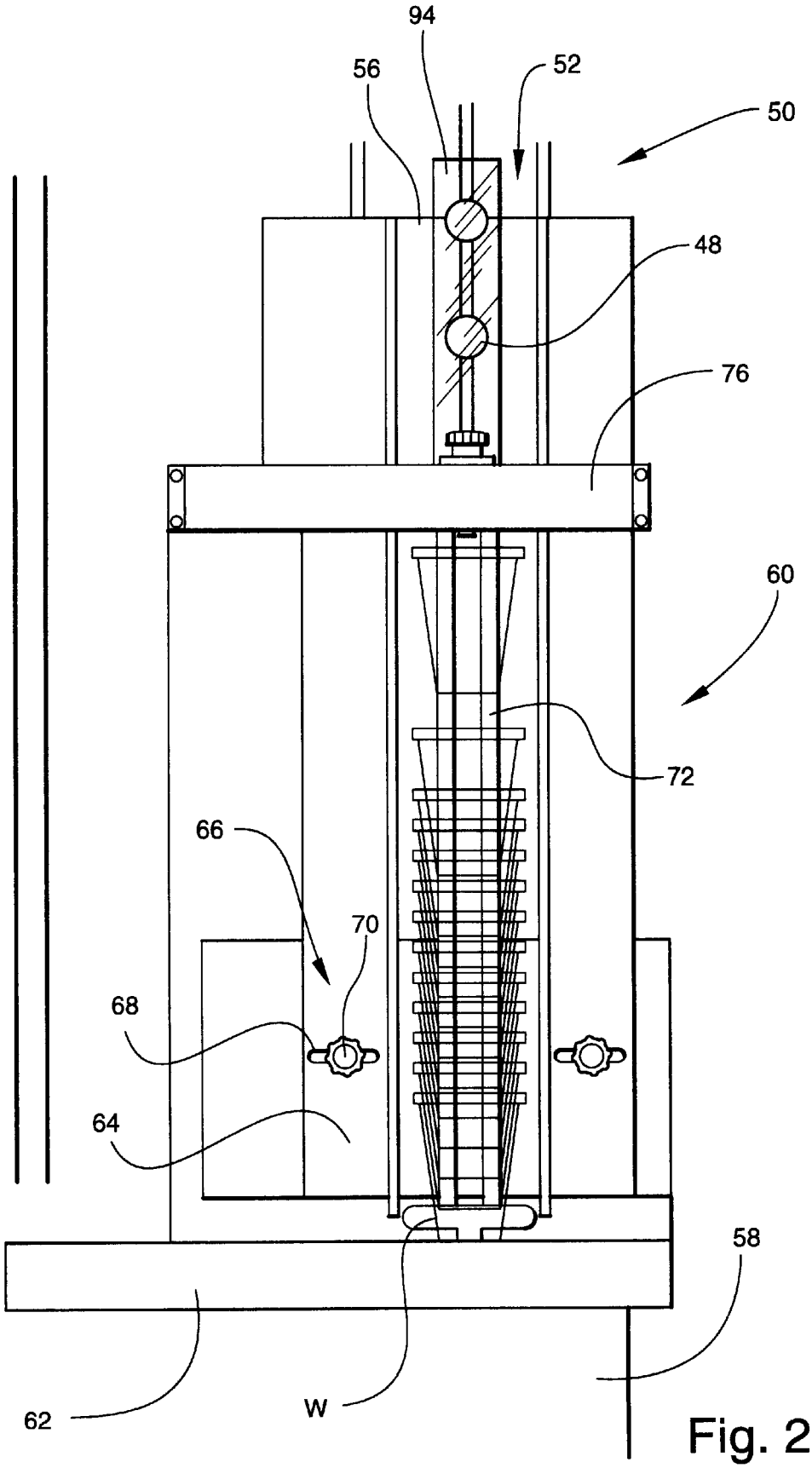
FIG. 2 is an elevational view of the workpiece removal assembly and the workpiece collection arrangement of the apparatus illustrated in FIG. 1.
Figure 3:
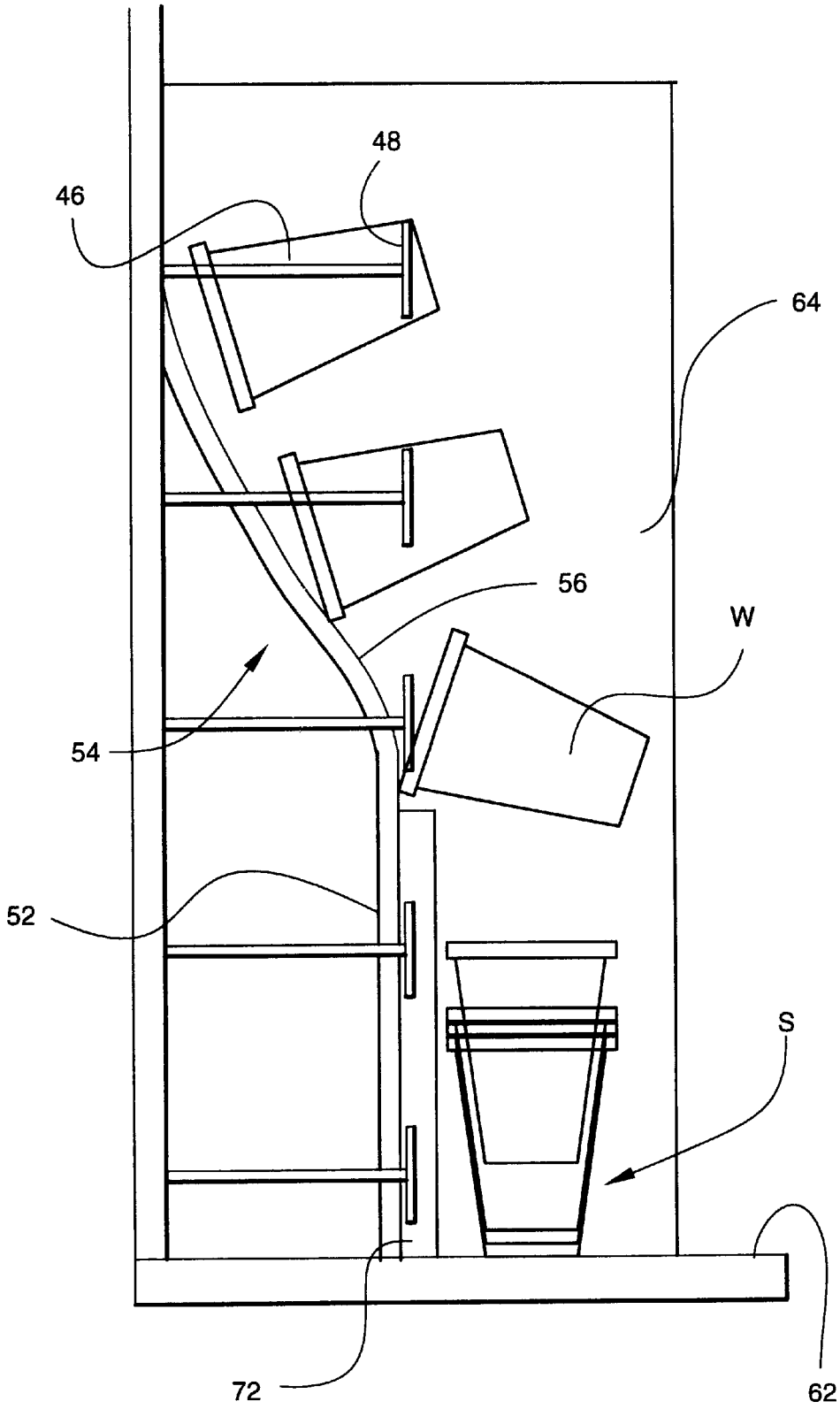
FIG. 3 is a side cutaway view of the workpiece removal assembly of the apparatus illustrated in FIG. 1 taken along line 3—3 in FIG. 2.
Figure 4:
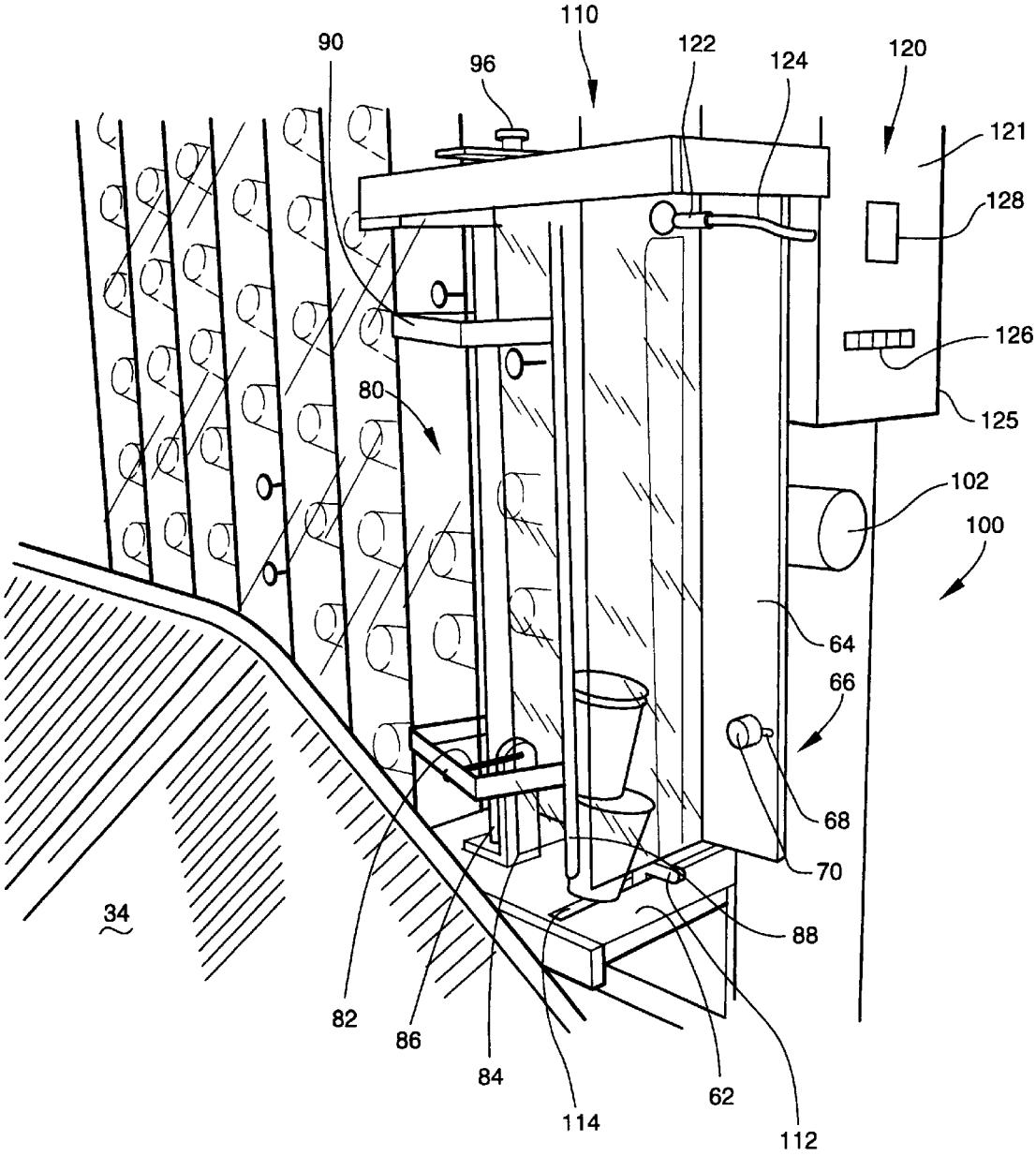
FIG. 4 is a perspective view of the workpiece collection arrangement of the apparatus illustrated in FIG. 1.
Figure 5:
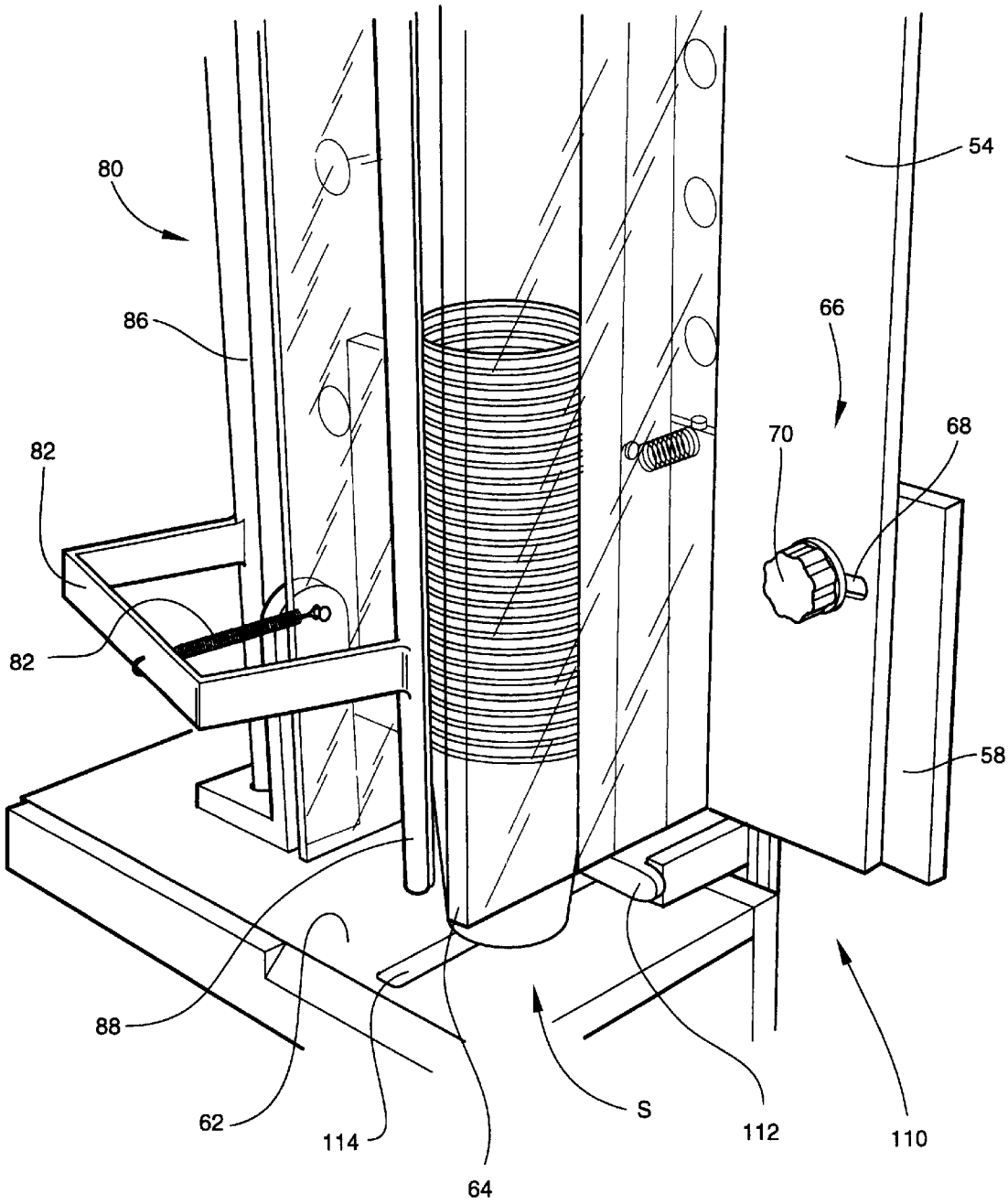
FIG. 5 is a second perspective view of the workpiece collection arrangement of the apparatus illustrated in FIG. 1.

The housing 12 incorporates several subsystems associated with the apparatus 10. The present invention includes a workpiece carrying assembly 40 which is best seen in FIG. 1. Also included is a workpiece removal assembly 50 seen in FIGS. 1, 2 and 3. Further, a workpiece collection arrangement 60 is provided and is seen in FIGS. 2 and 5. Other assemblies include a vibration inducing assembly, illustrated in FIG. 4 at 100, which operates in conjunction with the workpiece collection arrangement 60 to neatly stack the workpieces coming from the workpiece removal assembly 50. A workpiece ejector assembly 110, as seen in FIG. 5, is provided to operate in conjunction with the workpiece collection arrangement 60. A counter assembly 120 is provided which is seen in FIG. 4. This assembly is capable of operating in conjunction with the workpiece carrying assembly 40 and the workpiece ejector assembly 110 to automatically eject stacks of cups that have reached a predetermined quantity. With reference to FIG. 1, an air circulation assembly 130 is provided that assists in drying the workpieces as they transit the drying chamber 24. All of the foregoing assemblies will be explored in greater detail hereinafter.

In order to transport the workpieces W through the drying chamber 24, the workpiece carrying assembly 40 is utilized and is best seen in FIG. 1. As discussed above, the internal walls 14 of the housing 12 define a drying chamber 24 and a serpentine travel path 26 through the housing 12. A prime component of the workpiece carrying assembly 40 is an endless chain 42 trained around the plurality of sprockets 44 which allow the chain 42 to turn corners within the housing 12 to negotiate the channels defined by the internal walls 14 of the apparatus 10. The chain 42 is motor driven in a known manner by applying motive force to at least one of the sprockets to cause the chain to move along the travel path 26. A series of pins 46 are mounted to the chain 42 at periodic intervals. The pins 46 are intended to carry the workpieces W. A disc-like member forming a cap 48 is attached the end of each pin 46. The diameter of the cap 48 is substantially greater than that of the pin 46. The function of the cap 48 is best seen in FIG. 3 where a workpiece W is being carried by pin 46. The use of the cap 48 allows the frusto-conical cup to concentrate its weight at two points including the base of the pin 46 and the contact point with the cap 48. The use of the cap 48 greatly enhances the stability of the drinkware W as it is moved through the drying chamber 24.

Figure 6:
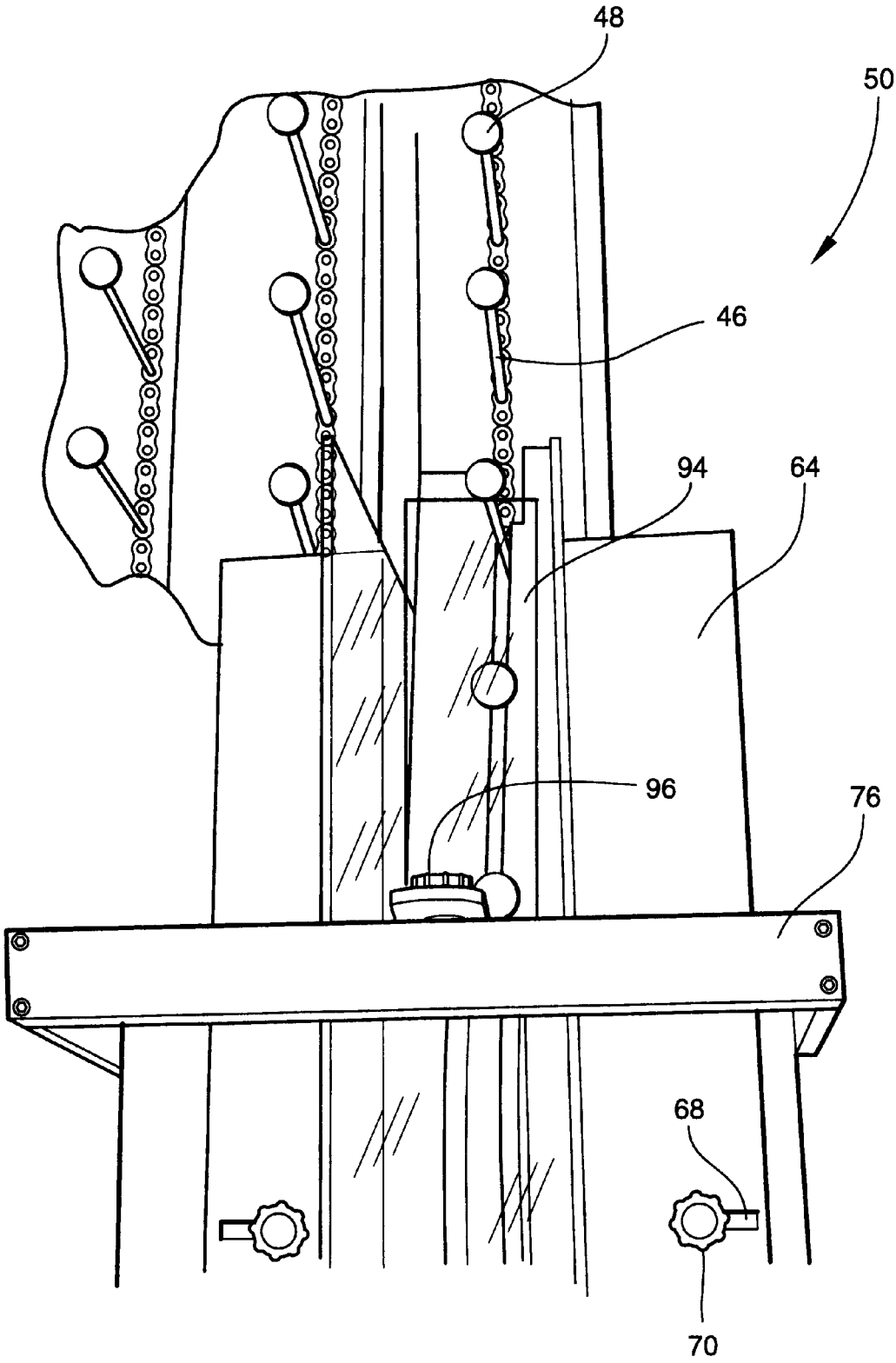
FIG. 6 is an elevational view with a portion of the workplace removal assembly.

Turning now to FIGS. 2, 3 and 6, the workpiece removal assembly is illustrated generally at 50 and includes a ramp 52. The ramp 52 defines an abutment surface 56 for contact with the workpieces W as seen in FIG. 3. As seen in FIG. 3, the ramp 52 and abutment surface 56 are gently curved from a region substantially flush with the endless chain 42 to a height approximately equal to the length of a pin 46 from its base to the base of the cap 48. A slot 54 is provided in the ramp 52 to allow pins 46 to pass through the ramp 52 as the ramp 2 removes the workpieces W from the pins 46. The workpiece carrying assembly 40 is supported on a planar mounting panel 58 attached to the housing 12. Operation of the workpiece removal assembly 50 will be described in greater detail hereinafter.

The workpiece collection arrangement 60 is provided to work with the workpiece removal assembly 50 to provide a neatly stacked arrangement of workpieces W. The function of the workpiece collection assembly 60 is to assist in gathering workpieces W that are removed from the pins 46 and facilitate the stack formation. The workpiece collection arrangement 60 includes a generally horizontally oriented platform 62 as seen in FIGS. 2–5. The workpiece collection arrangement 60 also includes two generally L-shaped, vertically oriented, lateral walls 64 that are mounted to the mounting panel 58 using an adjustment assembly 66. The lateral walls 64 restrict lateral displacement of the workpieces W after they are removed from the pins 48 and fall to the platform 62. To enhance the lateral controllability of the lateral walls 64, the adjustment assembly 66 includes two slots 68, with one slot 68 formed in each wall, as seen in FIG. 5. Knurled knobs 70 are attached to threaded members (not shown) projecting through the slot 68 so that as the knob 70 is tightened against the wall 64, the wall 64 is held in place against the mounting panel 58. By loosening the knobs 70, lateral adjustment of the walls 64 may be realized. A pair of minor guide rails 72 are attached to the lower, flat portion of the ramp 52 to assist in the guidance of workpieces W that are removed from the pins 46 and free-fall to the platform 62. The minor guide rails 72 also prevent the traveling caps 48 on the pins 46 from interfering with the workpiece stack S. This is best seen in FIG. 3.

In order to prevent workpiece movement away from the apparatus 10, a generally vertically oriented, front wall 94 is provided to cover an area adjacent the ramp 52, as best seen in FIG. 2. The front wall 94 helps to guide the workpieces W coming off the pins 46 into a downward trajectory. A cross member 76 is formed as a generally flat narrow U-shaped member extending across the workpiece collection arrangement 60. The front wall 94 is mounted to the cross member 76 and is adjustable using a knob 96 in a manner similar to the adjustment of the lateral walls 64.

Turning now to FIG. 4, the workpiece collection arrangement 60 also includes a pivotable support arm assembly 80. A support plate 84 is generally L-shaped and mounted to the platform 62. A second, upper support plate (not shown) is also provided to support the upper reaches of the support arm assembly 80. The support arm assembly 80 includes a pivoting base arm 86 that is mounted to the mounting plate 84 for pivotal movement. The pivoting base arm 86 is connected to a similar abutment arm 88 using cross braces 90 at an upper and lower position with respect to the arms 86, 88. A spring 82 is attached to the lower of the two cross braces 90 and is also attached to the mounting plate 84 to bias the abutment arm 88 into contact with the workpiece stack S. Since the pivoting base arm 86 is allowed to rotate and the flexible spring 82 allows some movement of the arm assembly, the abutment arm 88 can be moved in and out of a contact position with the workpiece stack S.

In order to remove the workpiece stack S efficiently from the platform 62, a workpiece ejector assembly 110 is provided. The workpiece ejector assembly 110 includes a moveable ram 112 which is generally shaped as an inverted "T". The ram 112 is reciprocated using a motor drive (not shown). The ram 112 is mounted to the apparatus 10 and moves outwardly from the workpiece collection assembly 60 adjacent the platform 62. A guide slot 114 defines the length of travel for the ram 112 and provides stability for movement of the ram 112.

The vibration inducing assembly 100 is provided in order to enhance the efficiency with which the workpieces W form a stack. The vibration inducing assembly 100 includes a motor 102 that drives an eccentric member (not shown) causing the workpiece collection assembly 60 to vibrate. This vibration agitates the workpieces W as they come loose from the pins 46 and free fall between the vertical walls 64 to the platform 62 and form a stack S. The vibration assists the workpieces W in forming a stack S by mechanically agitating the workpieces W, especially when the workpieces are lightweight thin-walled plastic cups. In that situation, the cups tend to nest more efficiently under vibration.

A counter assembly 120 is provided to accurately determine the number of cups that have passed through the drying chamber 24. The counter assembly 120 is incorporated into a control assembly 121 of the apparatus 10 and includes at least one optical sensor 122 mounted to the workpiece removal assembly 50 and in electrical communication with a control panel 125 using conventional wiring 124. The control panel 125 includes a series of switches 126 for controlling operation of the apparatus 10 and a counter 128 to display information from the optical sensor 122. Optionally, another optical sensor (not shown) may be placed near the entrance to the drying chamber 24 in order to count both input and output numbers. The optical sensors 122 and control arrangement allow the stacks to be uniform size. As the count of workpieces W reaches a predetermined number, the control panel 125 can activate the ram 112 to a move a predetermined number of workpieces W in a stack S.

In order to enhance the functionality of the drying chamber 24, an air circulation assembly 130 is provided, as seen in FIG. 1. The air circulation assembly 130 includes a motor driven fan 134 and a fan drive motor, illustrated generally at 132. Filtered air is drawn through the drying chamber 24 by the air circulation assembly 130 to enhance the ability of the cups W to dry on the pins 46 as they pass through the drying chamber 24. Optionally, the circulated air may be heated to further facilitate drying chamber 24.

Operation of the apparatus 10 will now be discussed with respect to a typical workpiece, including a screen printed plastic cup. In a typical installation, such light-weight plastic cups are screen printed individually and then individually placed on the workpiece carrying assembly 40. The endless chain 42 is caused to move, thereby moving the pins 46 through the drying chamber 24 and through the input channel 28. There, individual cups W are placed on individual traveling pins 46 for transit through the drying chamber 24.

A typical cup W on a typical pin 46 enters the drying chamber 24 and begins a vertical ascent through a first channel within the drying chamber 24. At the apex of the vertical ascent, the chain 42 turns around a sprocket 44 and the respective pin 46 begins a vertical descent toward another sprocket. This up-and-down vertical movement is repeated throughout the drying chamber 24 until the cups W encounter the ramp 52 of the workpiece removal assembly 50. Once the respective traveling pins 40 loaded with drinkware W reach the workpiece removal assembly 50, the drinkware W is removed from the pins 46 and urged to form a stack S by the workpiece collection arrangement 60. With reference to FIG. 3, as a respective pin 46 approaches the abutment surface 56 of the ramp 52, the inner portion of the cup W moves up the ramp 52 as the pin 46 proceeds into the slot 54 of the ramp 52 and continues its travel unimpeded.

With continued reference to FIG. 3, it can be seen and appreciated that as the pin 46 proceeds into the slot the inner portion of the cup W rides up the ramp 52 to a point where it is no longer stably supported by the pin 46 and cap 48. At this point, the cup W falls free of the traveling pin 46 and drops into the workpiece collection arrangement 60. Each respective pin 46 continues traveling along the travel path 26 intermediate the minor guide rails 72 so that the traveling pins 46 have no further influence on any removed cup W. As seen in FIG. 6, when the cups W are forced from the pins 46, the front wall 94 prevents the cups from moving out of the workpiece collection arrangement 60. Additionally, the vertical walls 64, having been pre-positioned using the adjustment assembly 66 to accommodate the widest portion of the cup W prevent lateral movement of the cups W out of the workpiece collection arrangement 60.

The cups free fall to the platform 62 and the first cup W in a stack determines the position of the stack in cooperation with the vertical walls 64 and the abutment rod 88. As further cups are removed from the pins 46 they also free fall and land in the prior cup W. Thusly, a stack S is formed.

Assisting in the stack formation are such systems as the optional vibration inducing assembly 100, the aforesaid lateral vertical walls 64 and the front wall 94. The lateral vertical walls 64, the front wall 94 and the abutment rod 88 essentially form a chute for a falling cups. The minor guide rails 72 help align the cups in addition to protecting the cups from the descending pins 46 and their caps 48. Further, the pivoting rod assembly 80 helps preserve stack integrity and maintain stack alignment by being biased into the stack S by the biasing spring 82.

Optionally, the operation of the device may be controlled by using the counter assembly 120 and counting the cups W as they are removed from the traveling pins 46. To that end, once a predetermined number of cups has formed a stack S, the control panel 125 uses a signal from the counter assembly 120 to cause the ram 112 to cycle which pushes the stacked cups off of the platform 62 and into the receiving bin 34 as seen in FIG. 1. The work cycle then repeats until a second predetermined number of cups is stacked and ejected from the platform 62. Optionally, if the counter is not used, the stack may be controlled by its height by positioning the optical sensor at a predetermined stack height such that when the stack height is realized, the ram cycles and the stack is removed from the platform 62. In addition, the counter may remain unused and the ram 112 manually controlled.

By the above, the present invention provides an efficient and reliable device for drying cups or other workpieces that have been treated with ink or other wet materials. The present invention provides and automatic removal device which does not involve grippers or claws of any sort and allows the cups to free fall into a stack such that when the stack reaches a predetermined height, a predetermined number of cups, or is determined to be sufficiently large by an operator, an automatic device is used to remove the stacks from the platform and into an awaiting storage bin.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for drying and stacking treated workpieces comprising:

a housing defining a drying chamber;

a workpiece carrying assembly mounted to said housing for moving the workpieces through a predetermined travel path through said drying chamber, said workpiece carrying assembly including an endless strand trained around a plurality of wheels, and a plurality of pins spaced along and projecting outwardly from said strand for supporting and carrying workpieces along said predetermined travel path;

a workpiece removal assembly for removing workpieces from said pins including a ramp disposed in said travel path and formed with an abutment surface and a slot formed therein through which said pins can pass, said ramp presenting said abutment surface to engage workpieces being carried on said pins wherein each workpiece is forced off its respective pin as said respective pin advances through said slot; and a workpiece collection arrangement mounted to said housing for receiving workpieces removed from said pins.

2. Apparatus for drying and stacking treated workpieces according to claim 1 wherein said travel path is generally vertically oriented and said pins are generally horizontally oriented wherein workpieces removed from said pins fall into said workpiece collection arrangement.

3. Apparatus for drying and stacking treated workpieces according to claim 2 wherein said workpiece collection arrangement includes a generally horizontally oriented platform for receiving workpieces from said workpiece removal assembly and a pair of generally vertically oriented walls disposed adjacent said travel path to reduce non-vertical movement of the workpieces as the workpieces fall to said platform.

4. Apparatus for drying and stacking treated workpieces according to claim 3 wherein said walls are laterally movably adjustable and said apparatus further comprises an assembly for selectively holding and releasing said walls to facilitate adjustment thereof.

5. Apparatus for drying and stacking treated workpieces according to claim 2 wherein the workpieces are nestable and said apparatus and further comprises a vibration inducing assembly in mechanical communication with said workpiece collection arrangement to induce workpieces in said workpiece collection arrangement to nest and form a stack.

6. Apparatus for drying and stacking treated workpieces according to claim 5 wherein said workpiece collection arrangement includes a pair of generally vertically oriented walls disposed adjacent said travel path to reduce non-vertical movement of the workpieces as the workpieces from said stack.

7. Apparatus for drying and stacking treated workpieces according to claim 6 wherein said walls are laterally movably adjustable and said apparatus further comprises an assembly for selectively holding and releasing said walls to facilitate adjustment thereof to facilitate adjustment thereof.

8. Apparatus for drying and stacking treated workpieces according to claim 2 wherein the workpieces are nestable and said apparatus further comprises a workpiece ejector assembly in mechanical communication with said workpiece collection arrangement to eject workpieces from said workpiece collection arrangement.

9. Apparatus for drying and stacking treated workpieces according to claim 8 wherein the workpieces form a stack when nested and workpiece ejector assembly includes a movable ram to selectively eject a workpiece stack from said workpiece collection arrangement.

10. Apparatus for drying and stacking treated workpieces according to claim 1 wherein said apparatus further comprises a counter assembly for counting workpieces carried on said pins.

11. Apparatus for drying and stacking treated workpieces according to claim 10 wherein the workpieces form a stack when nested and said workpiece ejector assembly includes a movable ram to selectively eject a workpiece stack from said workpiece collection arrangement responsive to a signal from said counter assembly when a predetermined number of workpieces has been carried on said pins.

12. Apparatus for drying and stacking treated workpieces according to claim 2 wherein said workpiece collection arrangement includes a generally vertically oriented pivotable support arm to support workpieces in said workpiece collection assembly.

13. Apparatus for drying and stacking treated workpieces according to claim 12 and further comprising a motor-driven air circulation assembly to circulate air within said drying chamber to assist in drying treated workpieces.

14. Apparatus for drying and stacking printed drinkware comprising:

a housing defining a drying chamber;

a drinkware carrying assembly mounted to said housing for moving the drinkware through a predetermined travel path through said drying chamber, said drinkware carrying assembly including an endless chain trained around a plurality of sprockets, and a plurality of pins spaced along and projecting outwardly from said chain for supporting and carrying drinkware along said predetermined travel path;

a drinkware removal assembly for removing drinkware from said pins including a ramp disposed in said travel path and formed with an abutment surface and a slot formed therein through which said pins can pass, said ramp presenting said abutment surface to engage drinkware being carried on said pins wherein a respective drinkware unit is forced off its respective pin as said respective pin advances through said slot; and a drinkware collection arrangement mounted to said housing for receiving drinkware removed from said pins.

15. Apparatus for drying and stacking treated drinkware according to claim 14 wherein said travel path is generally vertically oriented and said pins are generally horizontally oriented wherein drinkware removed from said pins falls into said drinkware collection arrangement.

16. Apparatus for drying and stacking treated drinkware according to claim 15 wherein said drinkware collection arrangement includes a generally horizontally oriented platform for receiving drinkware from said drinkware removal assembly and a pair of generally vertically oriented walls disposed adjacent said travel path to reduce non-vertical movement of the drinkware as the drinkware removed from said pins falls to said platform.

17. Apparatus for drying and stacking treated drinkware according to claim 16 wherein said walls are laterally movably adjustable and said apparatus further comprises an assembly for selectively holding and releasing said walls to facilitate adjustment thereof.

18. Apparatus for drying And stacking treated drinkware according to claim 15 wherein the drinkware is nestable and said apparatus and further comprises a vibration inducing assembly in mechanical communication with said drinkware collection arrangement to induce drinkware in said drinkware collection arrangement to nest and form a stack.

19. Apparatus for drying and stacking treated drinkware according to claim 18 wherein said drinkware collection arrangement includes a pair of generally vertically oriented walls disposed adjacent said travel path to reduce non-vertical movement of the drinkware as the drinkware forms said stack.

20. Apparatus for drying and stacking treated drinkware according to claim 19 wherein said walls are laterally movably adjustable and said apparatus further comprises an assembly for selectively holding and releasing said walls to facilitate adjustment thereof.

21. Apparatus for drying and stacking treated drinkware according to claim 15 wherein the drinkware is nestable and said apparatus further comprises a drinkware ejector assembly in mechanical communication with said drinkware collection arrangement to eject drinkware from said drinkware collection arrangement.

22. Apparatus for drying and stacking treated drinkware according to claim 21 wherein the drinkware forms a stack when nested and drinkware ejector assembly includes a movable ram to selectively eject a drinkware stack from said drinkware collection arrangement.

23. Apparatus for drying and stacking treated workpieces according to claim 14 wherein said apparatus further comprises a counter assembly for counting workpieces carried on said pins.

24. Apparatus for drying and stacking treated workpieces according to claim 23 wherein the workpieces form a stack when nested and said workpiece ejector assembly includes a movable ram to selectively eject a workpiece stack from said workpiece collection arrangement responsive to a signal from said counter assembly when a predetermined number of workpieces has been carried on said pins.

25. Apparatus for drying and stacking treated workpieces according to claim 15 wherein said drinkware collection arrangement includes a generally vertically oriented pivotable support arm to support drinkware in said drinkware collection assembly.

26. Apparatus for drying and stacking treated workpieces according to claim 14 and further comprising a motor-driven air circulation assembly to circulate air within said drying chamber to assist in drying treated drinkware.

27. Apparatus for drying and stacking treated workpieces comprising:

a housing defining a drying chamber;

a workpiece carrying assembly mounted to said housing for moving the workpieces through a predetermined travel path through said drying chamber, said workpiece carrying assembly including an endless strand trained around a plurality of wheels, and a plurality of pins spaced along and projecting outwardly from said strand for supporting and carrying workpieces along said predetermined travel path;

a workpiece removal assembly for removing workpieces from said pins;

a workpiece collection arrangement mounted to said housing for receiving workpieces removed from said pins, with said travel path being generally vertically oriented and said pins being generally horizontally oriented wherein workpieces fall into said workpiece collection arrangement; and a workpiece ejector assembly in mechanical communication with said workpiece collection arrangement including a movable ram to selectively eject workpieces from said workpiece collection arrangement.

28. Apparatus for drying and stacking treated workpieces according to claim 27 wherein said apparatus further comprises a counter assembly for counting workpieces carried on said pins.

29. Apparatus for drying and stacking treated workpieces according to claim 28 wherein the workpieces form a stack when nested and said workpiece ejector assembly includes a movable ram to selectively eject a workpiece stack from said workpiece collection arrangement responsive to a signal from said counter assembly when a predetermined number of workpieces has been carried on said pins.

30. Apparatus for drying and stacking treated workpieces according to claim 27 wherein said workpiece collection arrangement includes a generally horizontally oriented platform for receiving workpieces from said workpiece removal assembly and a pair of generally vertically oriented walls disposed adjacent said travel path to reduce non-vertical movement of the workpieces as the workpieces fall to said platform.

31. Apparatus for drying and stacking treated workpieces according to claim 30 wherein said walls are laterally movably adjustable and said apparatus further comprises an assembly for selectively holding and releasing said walls to facilitate adjustment thereof.

32. Apparatus for drying and stacking treated workpieces according to claim 30 wherein the workpieces are nestable and said apparatus and further comprises a vibration inducing assembly in mechanical communication with said workpiece collection arrangement to induce workpieces in said workpiece collection arrangement to nest and form a stack.

33. Apparatus for drying and stacking treated workpieces according to claim 32 wherein said workpiece collection arrangement includes a pair of generally vertically oriented walls disposed adjacent said travel path to reduce non-vertical movement of the workpieces as the workpieces from said stack.

34. Apparatus for drying and stacking treated workpieces according to claim 33 wherein said walls are laterally movably adjustable and said apparatus further comprises an assembly for selectively holding and releasing said walls to facilitate adjustment thereof.

35. Apparatus for drying and stacking treated workpieces according to claim 30 wherein said workpiece collection arrangement includes a generally vertically oriented pivotable support arm to support workpieces in said workpiece collection assembly.

36. Apparatus for drying and stacking treated workpieces according to claim 27 and further comprising a motor-driven air circulation assembly to circulate air within said drying chamber to assist in drying treated workpieces.

37. Apparatus for drying and stacking treated drinkware comprising:

a housing defining a drying chamber;

a drinkware carrying assembly mounted to said housing for moving the drinkware through a predetermined travel path through said drying chamber, said drinkware carrying assembly including an endless strand trained around a plurality of wheels, and a plurality of pins spaced along and projecting outwardly from said strand for supporting and carrying drinkware along said predetermined travel path;

a drinkware removal assembly for removing drinkware from said pins;

a drinkware collection arrangement mounted to said housing for receiving drinkware removed from said pins, with said travel path being generally vertically oriented and said pins being generally horizontally oriented wherein drinkware removed from said pins falls into said drinkware collection arrangement; and a drinkware ejector assembly in mechanical communication with said drinkware collection arrangement including a movable ram to selectively eject drinkware from said drinkware collection arrangement.

38. Apparatus for drying and stacking treated workpieces according to claim 37 wherein said apparatus further comprises a counter assembly for counting workpieces carried on said pins.

39. Apparatus for drying and stacking treated workpieces according to claim 38 wherein the workpieces form a stack when nested and said workpiece ejector assembly includes a movable ram to selectively eject a workpiece stack from said workpiece collection arrangement responsive to a signal from said counter assembly when a predetermined number of workpieces has been carried on said pins.

40. Apparatus for drying and stacking treated drinkware according to claim 37 wherein said drinkware collection arrangement includes a generally horizontally oriented platform for receiving drinkware from said drinkware removal assembly and a pair of generally vertically oriented walls disposed adjacent said travel path to reduce non-vertical movement of the drinkware as the drinkware removed from said pins falls to said platform.

41. Apparatus for drying and stacking treated drinkware according to claim 40 wherein said walls are laterally movably adjustable and said apparatus further comprises an assembly for selectively holding and releasing said walls to facilitate adjustment thereof.

42. Apparatus for drying and stacking treated drinkware according to claim 37 wherein the drinkware is nestable and said apparatus and further comprises a vibration inducing assembly in mechanical communication with said drinkware collection arrangement to induce drinkware in said drinkware collection arrangement to nest and form a stack.

43. Apparatus for drying and stacking treated drinkware according to claim 42 wherein said drinkware collection arrangement includes a pair of generally vertically oriented walls disposed adjacent said travel path to reduce non-vertical movement of the drinkware as the drinkware from said stack.

44. Apparatus for drying and stacking treated drinkware according to claim 43 wherein said walls are laterally movably adjustable and said apparatus further comprises an assembly for selectively holding and releasing said walls to facilitate adjustment thereof.

45. Apparatus for drying and stacking treated drinkware according to claim 38 wherein said drinkware removal assembly includes a ramp disposed in said travel path and formed with an abutment surface and a slot formed therein through which said pins can pass, said ramp presenting said abutment surface to engage drinkware being carried on said pins wherein a respective drinkware unit is forced off its respective pin as said respective pin advances through said slot.

46. Apparatus for drying and stacking treated workpieces according to claim 38 wherein said workpiece collection arrangement includes a generally vertically oriented pivotable support arm to support workpieces in said workpiece collection assembly.

47. Apparatus for drying and stacking treated workpieces according to claim 37 and further comprising a motor-driven air circulation assembly to circulate air within said drying chamber to assist in drying treated workpieces.

48. Apparatus for drying and stacking treated workpieces comprising:

a housing defining a drying chamber;

a workpiece carrying assembly mounted to said housing for moving the workpieces through a predetermined travel path through said drying chamber, said workpiece carrying assembly including an endless strand trained around a plurality of wheels, and a plurality of pins spaced along and projecting outwardly from said strand for supporting and carrying workpieces along said predetermined travel path;

a workpiece removal assembly for removing workpieces from said pins including a ramp disposed in said travel path and formed with an abutment surface and a slot formed therein through which said pins can pass, said ramp presenting said abutment surface to engage workpieces being carried on said pins wherein each workpiece is forced off its respective pin as said respective pin advances through said slot;

a workpiece collection arrangement mounted to said housing for receiving workpieces removed from said pins, with said travel path being generally vertically oriented and said pins being generally horizontally oriented wherein workpieces fall into said workpiece collection arrangement; and a workpiece ejector assembly in mechanical communication with said workpiece collection arrangement including a movable ram to selectively eject workpieces from said workpiece collection arrangement.

49. Apparatus for drying and stacking treated workpieces according to claim 48 wherein said apparatus further comprises a counter assembly for counting workpieces carried on said pins.

50. Apparatus for drying and stacking treated workpieces according to claim 49 wherein the workpieces form a stack when nested and said workpiece ejector assembly includes a movable ram to selectively eject a workpiece stack from said workpiece collection arrangement responsive to a signal from said counter assembly when a predetermined number of workpieces has been carried on said pins.

51. Apparatus for drying and stacking treated workpieces according to claim 48 wherein said workpiece collection arrangement includes a generally horizontally oriented platform for receiving workpieces from said workpiece removal assembly and a pair of generally vertically oriented walls disposed adjacent said travel path to reduce non-vertical movement of the workpieces as the workpieces fall to said platform.

52. Apparatus for drying and stacking treated workpieces according to claim 51 wherein said walls are laterally movably adjustable and said apparatus further comprises an assembly for selectively holding and releasing said walls to facilitate adjustment thereof.

53. Apparatus for drying and stacking treated workpieces according to claim 51 wherein the workpieces are nestable and said apparatus and further comprises a vibration inducing assembly in mechanical communication with said workpiece collection arrangement to induce workpieces in said workpiece collection arrangement to nest and form a stack.

54. Apparatus for drying and stacking treated workpieces according to claim 53 wherein said workpiece collection arrangement includes a pair of generally vertically oriented walls disposed adjacent said travel path to reduce non-vertical movement of the workpieces as the workpieces from said stack.

55. Apparatus for drying and stacking treated workpieces according to claim 54 wherein said walls are laterally movably adjustable and said apparatus further comprises an assembly for selectively holding and releasing said walls to facilitate adjustment thereof.

56. Apparatus for drying and stacking treated workpieces according to claim 49 wherein said workpiece collection arrangement includes a generally vertically oriented pivotable support arm to support workpieces in said workpiece collection assembly.

57. Apparatus for drying and stacking treated workpieces according to claim 48 and further comprising a motor-driven air circulation assembly to circulate air within said drying chamber to assist in drying treated workpieces.

58. Apparatus for drying and stacking treated drinkware comprising:

a housing defining a drying chamber;

a drinkware carrying assembly mounted to said housing for moving the drinkware through a predetermined travel path through said drying chamber, said drinkware carrying assembly including an endless strand trained around a plurality of wheels, and a plurality of pins spaced along and projecting outwardly from said strand for supporting and carrying drinkware along said predetermined travel path;

a drinkware removal assembly for removing drinkware from said pins including a ramp disposed in said travel path and formed with an abutment surface and a slot formed therein through which said pins can pass, said ramp presenting said abutment surface to engage drinkware being carried on said pins wherein a respective drinkware unit is forced off its respective pin as said respective pin advances through said slot;

a drinkware collection arrangement mounted to said housing for receiving drinkware removed from said pins, with said travel path being generally vertically oriented and said pins being generally horizontally oriented wherein drinkware removed from said pins falls into said drinkware collection arrangement; and a drinkware ejector assembly in mechanical communication with said drinkware collection arrangement including a movable ram to selectively eject drinkware from said drinkware collection arrangement.

59. Apparatus for drying and stacking treated workpieces according to claim 58 wherein said apparatus further comprises a counter assembly for counting drinkware carried on said pins.

60. Apparatus for drying and stacking treated workpieces according to claim 59 wherein the drinkware forms a stack when nested and said drinkware ejector assembly includes a movable ram to selectively eject a drinkware stack from said drinkware collection arrangement responsive to a signal from said counter assembly when a predetermined amount of drinkware has been carried on said pins.

61. Apparatus for drying and stacking treated drinkware according to claim 58 wherein said drinkware collection arrangement includes a generally horizontally oriented platform for receiving drinkware from said drinkware removal assembly and a pair of generally vertically oriented walls disposed adjacent said travel path to reduce non-vertical movement of the drinkware as the drinkware removed from said pins falls to said platform.

62. Apparatus for drying and stacking treated drinkware according to claim 61 wherein said walls are laterally movably adjustable and said apparatus further comprises an assembly for selectively holding and releasing said walls to facilitate adjustment thereof.

63. Apparatus for drying and stacking treated drinkware according to claim 61 wherein the drinkware is nestable and said apparatus and further comprises a vibration inducing assembly in mechanical communication with said drinkware collection arrangement to induce drinkware in said drinkware collection arrangement to nest and form a stack.

64. Apparatus for drying and stacking treated drinkware according to claim 63 wherein said drinkware collection arrangement includes a pair of generally vertically oriented walls disposed adjacent said travel path to reduce non-vertical movement of the drinkware as the drinkware from said stack.

65. Apparatus for drying and stacking treated drinkware according to claim 64 wherein said walls are laterally movably adjustable and said apparatus further comprises an assembly for selectively holding and releasing said walls to facilitate adjustment thereof.

66. Apparatus for drying and stacking treated drinkware according to claim 59 wherein said drinkware collection arrangement includes a generally vertically oriented pivotable support arm to support drinkware in said workpiece collection assembly.

67. Apparatus for drying and stacking treated workpieces according to claim 58 and further comprising a motor-driven air circulation assembly to circulate air within said drying chamber to assist in drying treated drinkware.

68. Apparatus for drying and stacking treated drinkware comprising:

a housing defining a drying chamber;

a drinkware carrying assembly mounted to said housing for moving the drinkware through a predetermined travel path through said drying chamber, said drinkware carrying assembly including an endless strand trained around a plurality of wheels, and a plurality of pins spaced along and projecting outwardly from said strand for supporting and carrying drinkware along said predetermined travel path;

a drinkware removal assembly for removing drinkware from said pins including a ramp disposed in said travel path and formed with an abutment surface and a slot formed therein through which said pins can pass, said ramp presenting said abutment surface to engage drinkware being carried on said pins wherein a respective drinkware unit is forced off its respective pin as said respective pin advances through said slot;

a drinkware collection arrangement mounted to said housing for receiving drinkware removed from said pins, with said travel path being generally vertically oriented and said pins being generally horizontally oriented wherein drinkware removed from said pins falls into said drinkware collection arrangement, said drinkware collection arrangement including a generally horizontally oriented platform for receiving drinkware from said drinkware removal assembly and a pair of generally vertically oriented, laterally movably adjustable walls disposed adjacent said travel path to reduce non-vertical movement of the drinkware as the drinkware removed from said pins falls to said platform and a generally vertically oriented pivotable support arm to support drinkware in said workpiece collection assembly;

an assembly for selectively holding and releasing said walls to facilitate adjustment thereof;

a counter assembly for counting drinkware carried on said pins; and a drinkware ejector assembly in mechanical communication with said drinkware collection arrangement includes a movable ram to selectively eject a drinkware stack from said drinkware collection arrangement responsive to a signal from said counter assembly when a predetermined amount of drinkware has been carried on said pins.

69. Apparatus for drying and stacking treated drinkware according to claim 68 wherein the drinkware is nestable and said apparatus and further comprises a vibration inducing assembly in mechanical communication with said drinkware collection arrangement to induce drinkware in said drinkware collection arrangement to nest and form a stack.

70. Apparatus for drying and stacking treated workpieces according to claim 68 and further comprising a motor-driven air circulation assembly to circulate air within said drying chamber to assist in drying treated drinkware.

* * * * *